United States Patent [19]

Lin

[11] Patent Number: 4,594,799

[45] Date of Patent: Jun. 17, 1986

[54] TENNIS SHOE CONSTRUCTION

[75] Inventor: Yung-Ho Lin, Taichung, China

[73] Assignee: Autry Industries, Inc., Dallas, Tex.

[21] Appl. No.: 680,184

[22] Filed: Dec. 10, 1984

[51] Int. Cl.[4] ..... A43B 5/00; A43B 13/14

[52] U.S. Cl. ..... 36/114; 36/32 R; 36/30 R

[58] Field of Search ..... 36/102, 114, 32 R, 25 R, 36/30 R, 28, 43

[56] References Cited

U.S. PATENT DOCUMENTS

| | | | |
|---|---|---|---|
| 3,705,463 | 12/1972 | Lown | 36/43 |
| 4,044,479 | 8/1977 | Brutting | 36/32 R |
| 4,069,598 | 1/1978 | Dassler | 36/114 |
| 4,245,406 | 1/1981 | Landay et al. | 36/32 R |
| 4,297,796 | 11/1981 | Stirtz et al. | 36/28 |
| 4,389,798 | 6/1983 | Tilles | 36/32 R |
| 4,449,307 | 5/1984 | Stvbblefield | 36/114 |

FOREIGN PATENT DOCUMENTS

| | | | |
|---|---|---|---|
| 2017719 | 11/1971 | Fed. Rep. of Germany | 36/32 R |
| 2525613 | 12/1976 | Fed. Rep. of Germany | 36/32 R |
| 2231332 | 1/1975 | France | 36/32 R |
| 501770 | 11/1954 | Italy | 36/32 R |
| 794956 | 1/1957 | United Kingdom | 36/102 |
| 1490219 | 10/1977 | United Kingdom | 36/32 R |

*Primary Examiner*—Werner H. Schroeder
*Assistant Examiner*—Steven N. Meyers
*Attorney, Agent, or Firm*—Jerry W. Mills; Gregory M. Howison

[57] ABSTRACT

An athletic shoe (10) comprises an outsole (12) and an upper (14) secured thereto and cooperating therewith to enclose the foot of the wearer. Upper (14) is of a one-piece full slip-on construction and is designed to overlay the dorsal and ventral surfaces of the foot and thus completely enclose the foot of the wearer. Outsole (12) comprises an upper layer (16) for being disposed adjacent the bottom surface of upper (14) and a lower layer (18) secured thereto for being disposed adjacent the ground. Upper layer (16) overlays lower layer (18) and includes side portions (20) which extend upwardly to overlap upper (14) and to be secured thereto. The upper surface of upper layer (16) includes a bridge (22) consisting of a plurality of diamond-shaped recesses extending laterally across the width of the shoe and rearwardly from a point proximate the instep of the foot to the heel of the foot.

7 Claims, 3 Drawing Figures

TENNIS SHOE CONSTRUCTION

TECHNICAL FIELD OF THE INVENTION

The present invention relates generally to athletic shoes and more specifically to an athletic shoe suitable for tennis, basketball and other vigorous sports.

BACKGROUND OF THE INVENTION

Athletic shoes suitable for tennis, basketball and other vigorous sports are well known and typically include a leather or vinyl plastic shoe upper for overlaying the dorsum of the foot, an insole for being disposed adjacent the sole of the foot and an outsole disposed adjacent the insole for being disposed adjacent the ground. The outsole has side portions which extend upwardly to overlap the upper to which it is secured by a suitable cement or other adhesive. The upper and outsole thus cooperate to enclose the foot of the wearer.

Because play in tennis, basketball and the like sports involves a substantial amount of running, jumping and similar vigorous movements, prior shoes for use in those sports have typically been relatively heavy and rigid so as to provide adequate support for the foot of the wearer during such activity and thus guard against injury. Though those prior shoes have thus provided the necessary support for the foot, the weight and rigidity of those shoes has added substantially to stress of the exercise.

The present invention overcomes the limitations of those prior athletic shoes by providing a sport shoe which adequately supports the foot of the wearer and thereby eliminates or at least reduces the incident of sport-related injuries, but yet is lightweight.

SUMMARY OF THE INVENTION

The present invention described and disclosed herein comprises an improved athletic shoe which is suitable for tennis, basketball and other vigorous sports and which is strong and lightweight.

The athletic shoe comprises an outsole and an upper secured thereto and cooperating therewith to complete the shoe. The upper is a one-piece full slip-on construction and is designed so as to overlay the dorsal and ventral surfaces of the foot and to thus completely enclose the foot of the wearer. The outsole is a two layer construction and comprises an upper layer for disposal adjacent the bottom surface of the upper and a lower layer bonded thereto for disposal adjacent the ground. The bottom layer carries a tread or other patterned surface for gripping and traction. The upper layer comprises side portions which extend upwardly to overlay and surround the upper and to be secured thereto. A plurality of diamond-shaped recesses are provided on the top surface of the upper layer and are formed integrally therewith. The recesses extend laterally across the width of the shoe and rearwardly from a point proximate the insole of the foot to the heel of the foot to provide increased flexibility to the outsole and to minimize the weight of the outsole.

In the preferred embodiment, a layer of canvas or other moisture absorbent material is provided on the bottom inner surface of the upper for disposal adjacent the sole of the foot. An insole constructed of fiberboard or similar rigid material is provided on the top surface of the upper layer of the outsole to overlay the recessed area to enhance the comfort of the wearer.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
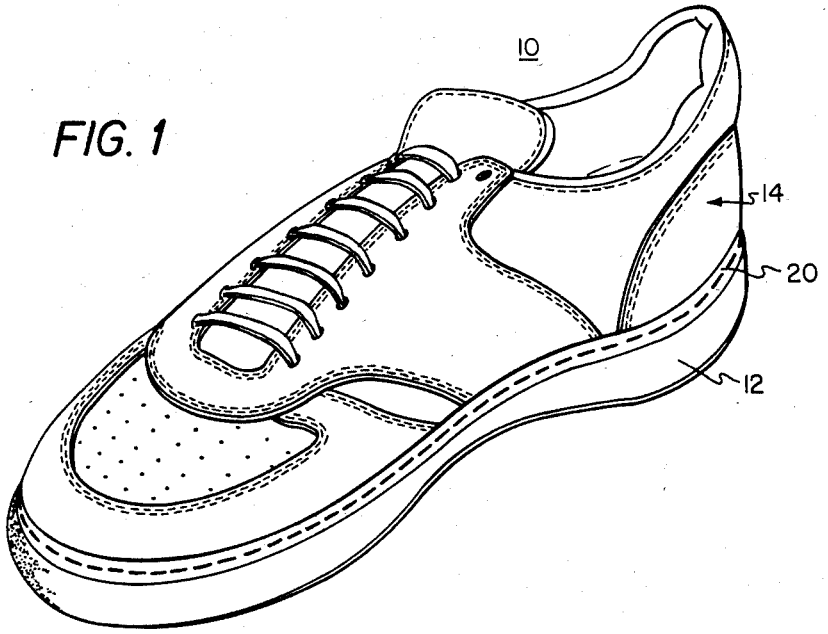
FIG. 1 is a perspective view of the athletic shoe of the present invention.

Referring to the Drawings in which like reference numerals designate like or corresponding parts throughout, FIG. 1 is a perspective view of the athletic shoe of the present invention. As shown in FIG. 1, the athletic shoe 10 comprises an outsole portion 12 and an upper 14 secured thereto and cooperating therewith to enclose the foot of the wearer. The upper 14 includes a tongue and is located in the conventional manner. The upper 14 may be formed of any suitable material such as leather or vinyl plastic.

Figure 2:
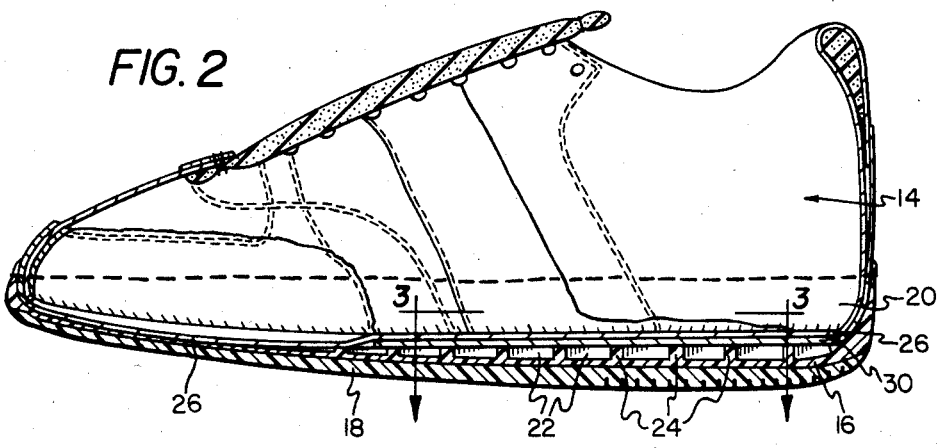
FIG. 2 is a sectional side view of the athletic shoe of FIG. 1.

As best seen in FIG. 2, upper 14 is of a one-piece, full slip-on construction and is designed so as to overlay the dorsal and ventral surfaces of the foot and to thus completely enclose the foot of the wearer. This construction differs from that typically used for tennis shoes in which the upper is designed to overlay the dorsum only of the foot.

FIG. 2 illustrates outsole 12 as including an upper layer 16 and lower layer 18. Upper layer 16 is formed of suitable resilient material such as natural or synthetic rubber and is disposed adjacent the bottom surface of the upper 14. Lower layer 18 is bonded to upper layer 16 and is formed of a hard rubber or other synthetic material for disposal adjacent the ground.

In the preferred embodiment, lower layer 18 carries a tread or other patterned surface on the undersurface thereof for gripping and traction. Upper layer 16 overlays lower layer 18 and includes side portions 20 (FIG. 1) which extend around the periphery of upper layer 16 and extend upwardly to overlay upper 14. Upper 14 is secured to the outsole 12 along the top surface of upper layer 16 and along side portions 20 by a suitable cement or other adhesive. In the preferred embodiment, upper 14 is further secured to outsole 12 by stitching along the periphery of the outsole proximate the topmost edge of side portions 20. Because upper 14 completely encloses the foot, an insole member such as that used in prior shoes need not be included, thus reducing the weight of the shoe.

Figure 3:
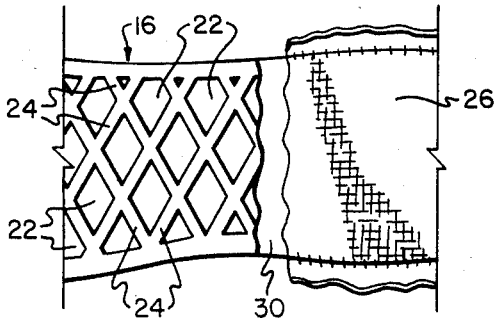
FIG. 3 is a top view of the upper layer of the outsole taken along lines 3—3 of FIG. 2 in the direction of the arrows, with a portion of the overlying sock and insole removed.

With reference now to FIGS. 2 and 3, the upper portion of upper layer 16 comprises a lattice or bridge 22 including a plurality of diamond-shaped recesses. The diamond-shaped recesses of bridge 22 are separated by intersecting raised ridges 24. The recesses of bridge 22 do not extend completely through upper layer 16. Ridges 24 are integral with the remainder of upper layer 16 and are formed of the same resilient material as upper layer 16. Bridge 22 extends laterally across the width of the shoe and rearwardly from a point proximate the insole of the foot to the heel of the foot, as best shown in FIG. 2. As also shown in FIG. 2, ridges 24 decrease in height from the heel portion to the insole. Bridge 22 provides increased cushioning and flexibility to the outsole and minimizes the weight of the outsole.

In the preferred embodiment, a sock 26 of canvas or other suitable moisture absorbent material is secured to the inner surface of upper 14 for being disposed proximate the sole of the foot. An insole 30 (FIGS. 2 and 3) is also preferably disposed beneath sock 26 and on the top surface of upper layer 16 to overlay bridge 22. Insole 30 is preferably constructed of fiberboard or similar rigid material and is provided to enhance the comfort of the wearer.

Thermoplastic rubber or similar padding material may also preferably be provided in the area of the shoe adjacent the heel of the wearer for further enhancing the comfort of the wearer.

In summary, an athletic shoe has been disclosed which is suitable for tennis, basketball and other vigorous sports. The shoe comprises an outsole portion and a one piece upper secured thereto and cooperating therewith to enclose the foot of the wearer. The outsole is of a two layer construction and includes an upper layer of resilient material for being disposed adjacent the bottom surface of the upper and a lower layer of harder material for being disposed adjacent the ground. A bridge consisting of a plurality of diamond shaped recesses is provided on the top surface of the upper layer and extends laterally across the width of the shoe and rearwardly from a point proximate the insole of the foot to the heel of the foot. The bridge enhances the flexibility of the outsole and also minimizes the weight of the shoe.

Although the preferred embodiment has been described in detail, it should be understood that various changes, substitutions and alterations can be made therein without departing from the spirit and scope of the invention as defined by the appended claims.

What is claimed is:

1. An athletic shoe comprising:

an outsole for disposal adjacent the sole of the foot;

a one-piece upper overlaying said outsole and secured thereto about the edges thereof, said upper adapted to overlay the dorsal and ventral surfaces of the foot to thus enclose the foot of the wearer;

said outsole having an upper layer for being disposed beneath said upper and further having a lower layer bonded to said upper layer for disposal adjacent the ground, said upper layer having side portions which extend upwardly to overlay and laterally surround said upper and being secured thereto, said upper layer also having integrally formed therewith on the top surface a plurality of recesses which extend across the entire width of the shoe and rearwardly from a point proximate the instep of the foot to the heel of the foot to provide increased flexibility to the outsole and to reduce the weight of the outsole; and an insole positioned on said upper layer from about said point proximate the instep to the heel to overlay said recesses.

2. The athletic shoe of claim 1 wherein said lower layer includes a tread on the under surface thereof for gripping and traction.

3. The athletic shoe of claim 1 wherein said outsole is constructed of rubber.

4. The athletic shoe of claim 1 wherein said upper is constructed of leather.

5. The athletic shoe of claim 1 wherein said insole is constructed of fiberboard.

6. The athletic shoe of claim 1 wherein a layer of absorbent material is disposed on the inner bottom surface of said upper for disposal adjacent the sole of the foot.

7. The athletic shoe of claim 1 wherein said recesses are diamond-shaped and are separated by intersecting raised ridges.

* * * * *